United States Patent [19]

McMillan

[11] 4,354,527

[45] Oct. 19, 1982

[54] CONTROL SYSTEM FOR PILOT OPERATED VALVE

[75] Inventor: William D. McMillan, Bartlesville, Okla.

[73] Assignee: Caterpillar Tractor Co., Peoria, Ill.

[21] Appl. No.: 261,094

[22] PCT Filed: Oct. 9, 1980

[86] PCT No.: PCT/US80/01339

§ 371 Date: Oct. 9, 1980

§ 102(e) Date: Oct. 9, 1980

[87] PCT Pub. No.: WO82/01402

PCT Pub. Date: Apr. 29, 1982

[51] Int. Cl.[3] ..... F15B 13/042

[52] U.S. Cl. ..... 137/625.63; 91/464; 137/625.6; 137/625.66

[58] Field of Search ..... 91/464; 137/625.6, 625.63, 137/625.66; 251/63.5

[56] References Cited

U.S. PATENT DOCUMENTS

| | | | |
|---|---|---|---|
| 3,160,174 | 12/1964 | Schmiel et al. | 91/464 |
| 3,486,418 | 12/1969 | Cryder et al. . | |
| 3,570,519 | 3/1971 | Bianchetta . | |
| 3,621,881 | 11/1971 | Vicari | 137/625.66 |
| 3,863,672 | 2/1975 | Theriot et al. | 137/458 X |
| 3,877,484 | 4/1975 | Theriot et al. | 137/625.66 |
| 3,918,847 | 11/1975 | Junck et al. . | |
| 4,041,983 | 8/1977 | Bianchetta | 137/625.66 X |
| 4,160,463 | 7/1979 | Akkerman et al. | 137/458 X |

FOREIGN PATENT DOCUMENTS 1494400 12/1977 United Kingdom .

*Primary Examiner*—Gerald A. Michalsky
*Attorney, Agent, or Firm*—John W. Grant

[57] ABSTRACT

Earthmoving vehicles commonly employ hydraulic systems (12) to control raising and lowering the operating implements. Hydraulic systems (12) of this type normally include a pilot control valve (34) having a spool (64) shiftable in response to a shifting force resulting from selectively directing pilot pressure thereto. Problems are encountered when hydraulic systems (12) are used to perform additional functions by shifting the spool (64) to positions requiring additional spool (64) travel. This additional spool (64) travel requires a considerable increase in shifting force, which results in a considerable reduction in the pilot pressure range available for raise and lower modulation. To eliminate this problem, a control system (14) for a pilot operated valve (34) is provided which includes an apparatus (50) for shifting the control valve spool (64) the additional travel distance by changing the magnitude of the shifting force acting thereon without changing the magnitude of the pilot pressure normally reserved for implement raise and lower modulation.

7 Claims, 1 Drawing Figure

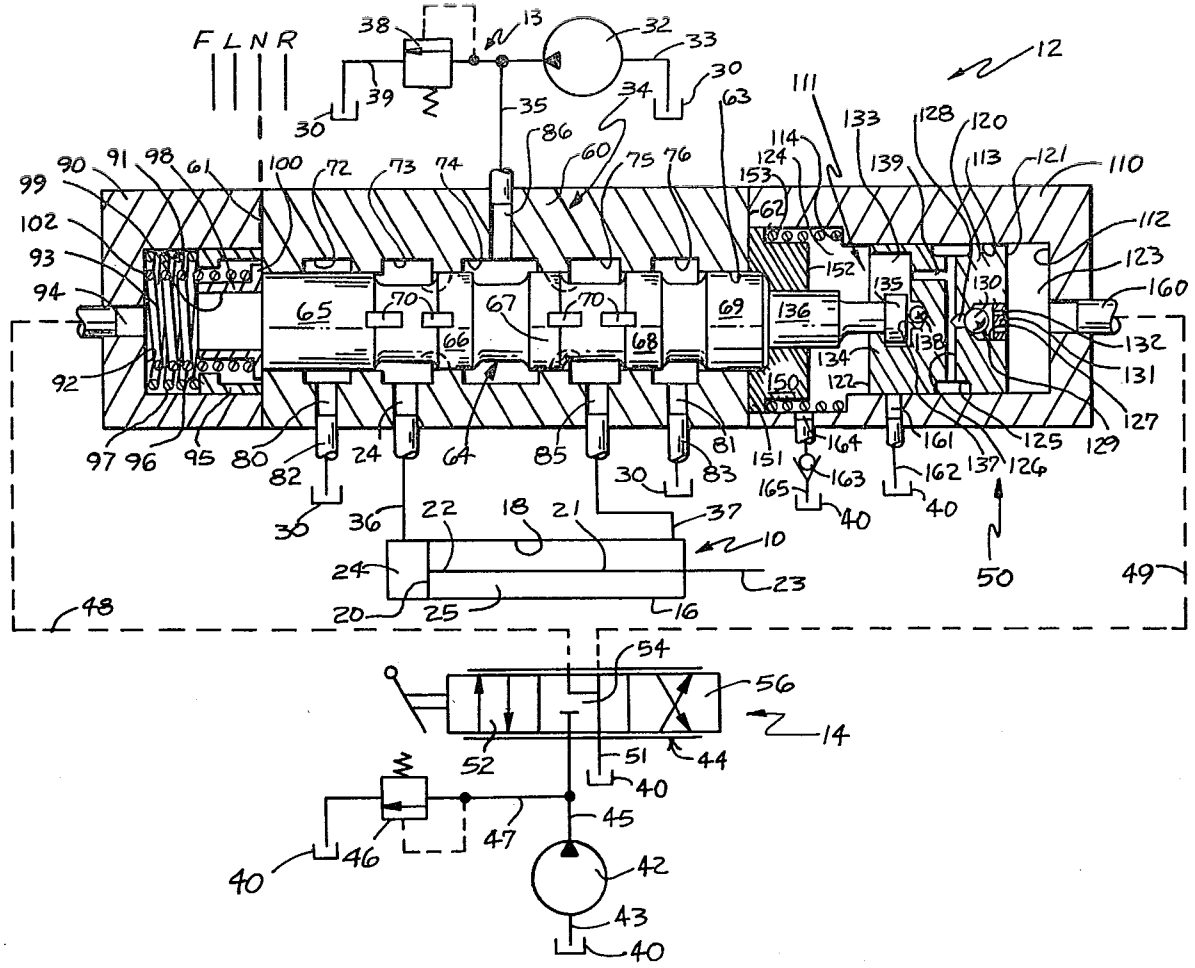
F L N R

CONTROL SYSTEM FOR PILOT OPERATED VALVE

TECHNICAL FIELD

This invention relates in general to a hydraulic control system and, more particularly, to a control system for a pilot operated valve that permits shifting of the valve spool in response to the position thereof in the valve body without providing additional pilot pressure.

BACKGROUND ART

Earthmoving vehicles, such as wheel and track dozers and loaders, are frequently employed in grading, clearing, and snow removal operations where it is desirable that the ground engaging implement or work tool follow the contour of the supporting surface. For example, when such a vehicle is used to remove snow from a paved surface, it is undesirable to have the implement dig into the pavement and impart damage thereto. To this end, such vehicles are equipped with an implement hydraulic circuit, which, when placed in the so called "float" mode, permits the work tool to rest on the supporting surface by virtue of the force of gravity acting thereon and thereby follow the supporting surface contour.

Hydraulic systems employed in this type of vehicle to control the raising and lowering of the work tool commonly include a pilot operated control valve having a control spool shiftable in response to a shifting force resulting from selectively directing pilot pressure thereto. The work tool is controlled by shifting the spool in the control valve to either a power up or raise position, a neutral or hold position, or a power down or lower position. The float position is commonly obtained by shifting the control circuit spool to a fourth position beyond power down. This type of float requires additional spool travel in the lower direction over that required in the raised direction. In a pilot operated system this additional spool travel requires a considerable increase in shifting force above what is required to attain the power up or power down positions. Thus, a proportional amount of pilot supply pressure must be reserved for this additional shift, and the pilot pressure range alloted for raise and lower modulation is reduced.

Prior art pilot operated control systems employ pilot control pumps and control systems that provide added pilot pressure to obtain additional spool travel in response to shifting of an infinitely variable pilot valve. In systems of this type, shifting of the pilot valve results in a metering effect, in that the pilot pressure delivered to the control spool varies in a relationship directly proportional to the displacement of the pilot control valve, thereby providing a higher pilot supply pressure than the normal shift pressure to achieve the additional spool travel.

The foregoing illustrates limitations of the known prior art. In view of the above, it would be advantageous to provide a control system for a pilot operated valve which would permit the additional spool travel required to obtain a float position and yet preserve a large percentage of pilot source pressure for the raise and lower modulation positions.

DISCLOSURE OF THE INVENTION

In one aspect of the present invention, this is accomplished by providing a control system for a pilot operated valve including means for shifting the spool in the control valve by changing the magnitude of the shifting force acting thereon in response to the position of the spool in the valve without changing the magnitude of the pilot pressure.

The foregoing and other aspects will become apparent from the following detailed description of the invention when considered in conjunction with the accompanying drawing. It is to be expressly understood, however, that the drawing is not intended as a definition of the invention but is for the purpose of illustration only.

BRIEF DESCRIPTION OF THE DRAWING

The drawing is a schematic view of a hydraulic system including a pilot operated control valve having a control system constructed in accordance with the present invention and having portions in section to better illustrate the elements thereof.

BEST MODE FOR CARRYING OUT THE INVENTION

While this invention has general application as a control system for a pilot operated valve, for convenience of illustration the preferred embodiment will be described with reference to a control system for a pilot operated control valve for controlling the operation of a fluid powered actuator, but is not intended to be limited thereto.

Referring to the drawing, a hydraulic system for directing pressurized fluid to a fluid powered actuator or hydraulic jack 10 is illustrated generally by the numeral 12. The hydraulic system includes an operating circuit 13 for supplying fluid at a preselected operating pressure to the actuator, and a control system 14 for controlling flow of the operating fluid to the actuator.

More specifically, the actuator 10 includes a housing 16 having a cylindrical bore 18, a reciprocating or telescoping piston 20 disposed in the bore, and an elongate rod 21 secured at a first end 22 to the piston and including a second end 23 extending from the actuator housing for manipulation of a work implement or tool (not shown). The piston is slidably engaged in the bore and defines a head and chamber 24 and a rod end chamber 25 within the housing.

Referring now to the operating circuit 13, it includes a fluid reservoir 30 and a source of pressurized fluid or pump 32 which draws fluid from the reservoir via a conduit 33. Fluid from the pump is communicated to a pilot operated control valve 34 of the control system 14 via a conduit 35 and thereafter, selectively to either the head end chamber 24 or the rod end chamber 25 of the actuator 10 via conduits 36 and 37 respectively. A relief valve 38 disposed in a conduit 39 intermediate the conduit 35 and the reservoir controls the maximum pressure in the operating circuit.

Referring now to the control system 14, it includes, in addition to the pilot operated control valve 34, a reservoir 40, a source of pressurized pilot fluid or pilot pump 42 which draws pilot fluid from the reservoir via a conduit 43, and a pilot control valve 44 for selectively directing the pilot fluid to the pilot operated valve 34. The pump delivers pilot fluid to the pilot control valve 44 via a conduit 45 at a preselected maximum pressure controlled by a relief valve 46 disposed in a conduit 47 intermediate the conduit 45 and the reservoir. The pilot control valve 44 is in fluid communication with the pilot operated valve 34 via conduits 48, conduit 49 and shifting means 50, and with the reservoir via a conduit 51 and has three operating positions for conditioning the pilot operated valve. These positions include a first operating position 52 for extending the actuator, a second neutral position 54, and a third operating position 56 for retracting the actuator.

The pilot operated control valve 34 includes a body portion or a housing 60 having a first end 61, a second end 62, an open-ended bore 63 extending between the first and second ends, and a spool 64 reciprocally disposed in the bore. The spool includes a plurality of lands 65, 66, 67, 68, 69 and is selectively positionable in response to fluid directed thereto by the pilot control valve 44 to a first operating position for extending the actuator, a second neutral position (as shown in the drawing), a third operating position for retracting the actuator, and a fourth or float position. Each of the lands 65–68 preferably includes at least one slot 70 to provide a metering effect of the fluid flow therethrough and thus more precise control over the actuator.

The control valve housing 60 includes a plurality of annular chambers 72, 73, 74, 75, 76 formed circumferentially about and axially spaced along the bore. The annular chambers 72 and 76 are fluid drain passages which are interconnected to the reservoir 30 via drain ports 80 and 81 and conduits 82 and 83 respectively. The annular chamber 73 is in fluid communication with the head end chamber 24 of the actuator 10 via a passageway 84 and the conduit 36, and the annular chamber 75 is in fluid communication with the rod end chamber 25 of the actuator via a passageway 85 and the conduit 37. The annular chamber 74 is in fluid communication with the annular chambers 73 and 75 via the bore and is in fluid communication with the pump 32 via the conduit 35 and a passageway 86.

Referring now to the first end 61 of the valve body 60, a housing or end cap 90 is secured thereto and includes an open ended bore 91 having a radially extending end face 92. A chamber 93 defined by the bore, the radially extending end face and the first end of the valve body, is in fluid communication with the pilot control valve 44 via a passageway 94 and the conduit 48. An annular spacer 95 having an inwardly extending annular lip or stop portion 96 is slidably disposed in the chamber and urged into abutment with the first end of the valve body by spring biasing means 97. A cylindrical guide member or spring retainer 98 having a cylindrical bore 99 extending therethrough and a radially outwardly extending flange portion 100 is reciprocally positioned coaxially within the annular spacer and in abutment with the spool 64. An urging means 102 is provided in the end cap for continuously biasing the spool toward the neutral operating position. Preferably, the urging means 102 is a coiled metal compression spring coaxially disposed in the chamber over the cylindrical guide member 98 intermediate the radially outwardly extending flange 100 thereof and the radially extending face 92.

Referring now to the second end 62 of the valve body 61, the shifting means 50 includes a housing or end cap 110 secured thereto having an internal cavity 111 defined by a radially extending end face 112 and a stepped bore 113 having a first diameter and a second, larger diameter separated by a step or shoulder 114. A piston 120 having first and second axially spaced end faces 121 and 122 is reciprocatingly disposed in the portion of the bore having the smaller diameter and cooperates with the second end of the valve body and the housing in defining first and second chambers 123 and 124.

An annular recess 125 positioned intermediate the end faces of the piston 120 extends circumferentially thereabout, and a fluid passageway 126 extending transversely through the piston interconnects diametrically opposed portions of the recess. A recess 127 formed in the first end face 121 of the piston is in fluid communication via an axially extending passageway 128 with the transversely extending passageway 126 and includes a seat portion 129 adapted to receive a ball 130 and a retaining cap 131 having a plurality of vent passageways 132 extending therethrough. The second end face 122 of the piston has a cavity 133 formed therein and includes a retaining lip 134 adapted to receive a transversely extending flange or head 135 secured to a stem 136 extending axially outwardly from the spool 64. A seat 137, having a bearing 138 disposed therein intermediate the head portion of the stem and the piston, is formed in the cavity, and a second axially extending passageway 139 communicates the cavity with the passageway 126 extending transversely through the piston.

A cylindrical guide member or spring retainer 150, having a radially outwardly extending flange 151, is slidably disposed in the second chamber 124 over the stem 136 extending from the spool 64 and includes an axially outwardly facing flat surface portion 152. Urging means 153 is provided in the housing 110 for continuously biasing the spool toward the neutral operating position. Preferably, the urging means 153 is a coiled metal compression spring coaxially disposed in the second chamber over the cylindrical guide member intermediate the radially outwardly extending flange thereof and the step 114 in the bore 113.

The first end chamber 123 is in fluid communication with the pilot control valve via a passageway 160 and the conduit 49. The stepped bore 113 of the housing 110 is in fluid communication with the reservoir 40 via a drain port 161 and a conduit 162. A make-up valve 162 is in fluid communication with the second chamber 124 and the reservoir 40 via a passageway 164 and a conduit 165 to permit additional fluid to be drawn into the second chamber should pressure lower than that in the reservoir be experienced thereat.

INDUSTRIAL APPLICABILITY

With the parts assembled as set forth above, the control system of the present invention has application wherever it is desirable to obtain additional valve spool travel in a pilot operated valve without increasing the magnitude of the pilot pressure. One such application is in a track or wheel dozer or loader having a pilot operated control valve including a float position to permit the implement or work tool to follow the contour of the ground.

Referring to the drawing, when the pilot control valve 44 is in the neutral position as shown, the flow of pilot fluid from the pilot pump 42 to the control valve 34 is blocked and is directed to the reservoir 40 via the relief valve 46. The springs 102, 153 respectively positioned in the housing 90, 110, secured to the first and second ends 61, 62 of the valve body 60, urge the valve spool 64 to a neutral position. Operating fluid in the hydraulic operating circuit 13 is directed to the reservoir 30 via the conduit 39 and the relief valve 38 and fluid flow to and from the head and rod end chambers 24, 25 of the actuator 10 is blocked by the lands, thereby locking the implement in position.

Extension of the actuator 10 to raise the implement is achieved by shifting the pilot control valve 44 to the first operating position 52. Pilot fluid is communicated via the conduit 48 and the passageway 94 to the chamber 93. The pilot fluid pressure exerted on the exposed end surface area of the spool 64 generates a force sufficient to shift the spool to the right as viewed in the drawing against the opposing force exerted by the spring 153. Pilot fluid in the chamber 123 is vented to the reservoir 40 via passageway 160, conduit 49, the pilot control valve, and conduit 51. Operating fluid from the pump 32 is directed by the conduit 35 and the passageway 86 via the annular chambers 74 and 73, the bore 63, passageway 84 and conduit 36 to the head end chamber 24 of the actuator.

Fluid in the rod end chamber 25 is forced into the rod end conduit 37, through the passageway 85 into the annular chambers 75 and 74 and the bore 63 in response to movement of the piston 20, whereupon it is communicated via the drain port 81 and the conduit 83 to the reservoir 30. Movement of the actuator can continue until the piston travels the full length of the bore 18; however, movement of the piston and extension of the actuator may be stopped at any intermediate position by the operator by returning the pilot control valve to the neutral position 54. Thereupon the force exerted by the spring 153 urges the spool in the control valve to its neutral position, and fluid in the chamber 93 is vented via the passageway 94 and the conduit 48 to the reservoir 40.

To lower the implement, the operator shifts the pilot control valve 44 to its second operating position 56 whereupon fluid from the pilot pump 42 is communicated to the first chamber 123. The pilot shifting pressure creates a shifting force on the first end face 121 of the piston 120. This force is opposed by the force of the spring 102 acting through the spool 64 and fluid trapped in the second chamber 124 acting upon the second end face 122 of the piston. The trapped fluid in the second chamber also acts upon the exposed surface area of the spool and aides the shifting force acting on the first surface of the piston. The excess fluid in chamber 124 that is being displaced will cause ball 130 to be moved from its seat, thus, the result is a shifting force equal to the pilot pressure acting upon an area equivalent to the exposed spool surface area opposed by the force of the spring, which results in a net force sufficient to move the spool to the left as viewed in the drawing.

Pilot fluid in the housing 90 is vented to the reservoir 40 via passageway 94, conduit 48, the pilot control valve, and conduit 50 in response to shifting of the spool. Operating fluid from the pump 32 is communicated to the rod end chamber 25 of the actuator via annular chambers 74 and 75, the bore 63, passageway 85, and conduit 37. In response to movement of the piston 20, fluid in the head end chamber 24 of the actuator is forced via conduit 36, passageway 84, annular chambers 73, 72, the bore 63, port 80, and conduit 82 to the reservoir 30. As hereinbefore described, movement of the piston can continue until it has traveled the length of the actuator or until the control spool is returned to its neutral position by the operator shifting the pilot control valve to its neutral position.

To allow the work tool or implement to follow the contour of the supporting surface or "float", the pilot control valve is placed in the second operating position 56. The control and operating hydraulic systems function as hereinbefore described with reference to lowering the implement. However, as the control spool 64 moves to the left as viewed in the drawing to attain equilibrium between the shifting force and the opposing force exerted by the spring 102, the fluid in the second chamber 124, communicated via passageways 139, 126 and 128, unseats the ball 130 in the cavity 127 in the first end face 121 of the piston 120, thereby permitting transfer of fluid from the second chamber to the first chamber. The spool continues to move in this manner until the annular recess 125 extending circumferentially about the piston opens with the drain port 161. At this time, pressure in the second cavity is vented to the reservoir 40 via port 161 and the conduit 162. The pilot pressure in the first chamber then seats the ball and the shifting force increases to a value equal to the shifting pressure acting upon the first end face of the piston without a change in the magnitude of the pilot pressure supplied by the control system.

The initial pilot pressure force acts against spring 102. Once the annular recess 125 is vented to the reservoir 40 the extra force acting on the piston is resisted by both the springs 102 and 97. The spool will continue to shift to the left until it contacts the end face 92. With the spool in float position, the pump 32 and the head and rod end chambers 24 and 25 are in fluid communication with one another and with the reservoir 30 via conduit 35, passageway 86, bore 63, annular chambers 73, 74, 75, 76, passageways 84, 85, ports 80, 81 and conduits 36, 37, 82 and 83.

When pilot pressure is removed from the first chamber 123, the force of the springs 97, 102 return the control spool and piston to the neutral position. Pilot fluid in the first chamber 123 is vented to the reservoir 40 in response to movement of the piston 120 via passageway 160 and conduit 49. The second chamber 124 is recharged with fluid from the reservoir via the make-up valve 163, conduit 165, and passageway 164 in response to a lower pressure caused therein by cavitation of the second chamber.

While the present invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the scope of the appended claims.

I claim:

1. An apparatus (50) for shifting the spool (64) of a pilot operated valve (34) in one direction and changing the magnitude of a shifting force acting on the spool (64) in response to the spool (64) reaching a predetermined position in the valve (34) without changing the magnitude of the pilot pressure, comprising:

a source (42) of pressurized pilot fluid;

means (44) for selectively directing pilot fluid to the spool (64);

a housing (110);

a piston (120) connected to the spool (64) and reciprocally disposed in the housing (110) and defining first and second chambers (123,124);

a passageway (128, 126, 139) connecting the first and second chambers (123,124);

means (49, 160) for communicating pilot fluid to the first chamber (123);

means (127, 128, 129, 130) for controllably blocking communication of pilot fluid between the first and second chambers (123,124) through the passageway (128, 126, 139); and means (139, 126, 125) for venting pilot fluid from the second chamber (124) in response to the spool (64) reaching the predetermined position in the bore (63).

2. The apparatus (50) of claim 1 including means (163, 164, 165) for communicating make-up fluid into the second chamber (124) in response to movement of the piston (120) and spool (64) in an opposite direction.

3. The apparatus (50) of claim 1 wherein the blocking means (127, 128, 129, 130) comprises a check valve (127, 128, 129, 130) positioned in the passageway (128, 136, 129).

4. The apparatus (50) of claim 1 wherein the passageway (128, 136, 129) connecting the first and second chambers (123,124) is located in the piston (120).

5. The apparatus (50) of claim 1 wherein the means (139, 126, 125) for venting pilot fluid from the second chamber (124) includes a passageway (139, 126, 125) positioned in the piston (120).

6. The apparatus (50) of claim 1 wherein the passageway (128, 126, 139) connecting the first and second chambers (123, 124) is located in the piston (120) and the means (139, 126, 125) for venting pilot fluid from the second chamber (124) includes a passageway (139, 126, 125) positioned in the piston (120).

7. The apparatus (50) of claim 6 wherein the passageway (128, 126, 139) connecting the first and second chambers (123, 124) is in fluid communication with the means (139, 126, 125) for venting of pilot fluid from the second chamber (124).

* * * * *